US009339857B2

(12) United States Patent
Keller et al.

(10) Patent No.: US 9,339,857 B2
(45) **Date of Patent: *May 17, 2016**

(54) ROLL ARRANGEMENT

(71) Applicant: SMS Siemag AG, Duesseldorf (DE)

(72) Inventors: Karl Keller, Hilchenbach (DE); Johannes Alken, Siegen (DE); Konrad Roeingh, Hilchenbach (DE); Kurt Scheffe, Hilchenbach (DE)

(73) Assignee: SMS Group GmbH, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/406,614

(22) PCT Filed: Jun. 7, 2013

(86) PCT No.: PCT/EP2013/061820

§ 371 (c)(1),
(2) Date: Mar. 17, 2015

(87) PCT Pub. No.: WO2013/186141

PCT Pub. Date: Dec. 19, 2013

(65) Prior Publication Data

US 2015/0174627 A1 Jun. 25, 2015

(30) Foreign Application Priority Data

Jun. 12, 2012 (DE) ..... 10 2012 209 828

(51) Int. Cl.
*B21B 31/07* (2006.01)
*B21B 27/00* (2006.01)

(52) U.S. Cl.
CPC ..... *B21B 31/074* (2013.01); *B21B 27/00* (2013.01); *B21B 31/07* (2013.01); *B21B 31/078* (2013.01)

(58) Field of Classification Search
CPC ..... B21B 31/074; B21B 27/00; B21B 27/02; B21B 27/021; B21B 27/03; B21B 27/032; B21B 27/05; B21B 13/00; B21B 13/06; B21B 31/07; B21B 31/078; Y10T 29/49544; Y10T 29/49549
See application file for complete search history.

(56) References Cited

U.S. PATENT DOCUMENTS 2,955,002 A 10/1960 Rich, Jr.
4,159,152 A 6/1979 Bjork
(Continued)

FOREIGN PATENT DOCUMENTS

EP 285333 10/1988

OTHER PUBLICATIONS

SMS Group Newsletter "Morgoil-KLX® —Bearing Successful in Operation", No. 1, Apr. 2009, pp. 50-51.

*Primary Examiner* — Christopher Besler
(74) *Attorney, Agent, or Firm* — Abelman, Frayne & Schwab

(57) ABSTRACT

The invention relates to a roll arrangement for use in metallurgical technology, comprising a roll that has a roll barrel and two roll necks, and at least one neck bushing for accommodating at least one of the roll necks in a rotationally fixed manner. A carrier element that functions as a form-locking rotationally fixed connection is arranged between the roll neck and the neck bushing. In order to increase the load-bearing capacity of the roll bearing without increasing the size of or the mounting space for the roll bearing and at the same time ensure easy assembly, the roll neck is mounted in the neck bushing with some radial play such that a circumferential cavity is formed between the neck bushing and the roll neck in the unloaded stated as a result of the radial play. In order to increase the size of the cavity, the roll neck or the inner surface of the neck bushing additionally has a concave contour or profile.

7 Claims, 3 Drawing Sheets

(56) References Cited

U.S. PATENT DOCUMENTS

Figures 1, 1A:
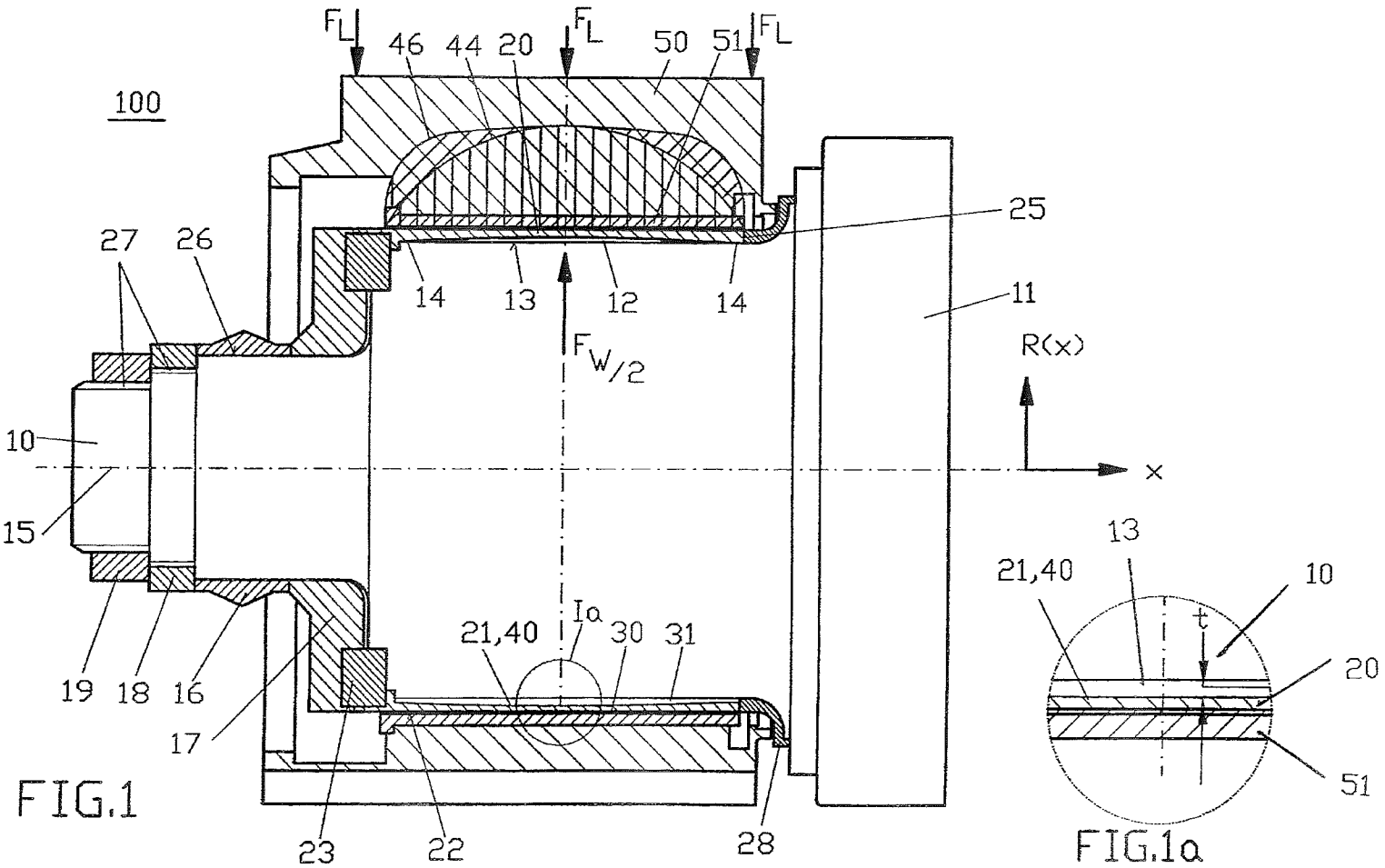

| | | | | |
|---|---|---|---|---|
| 4,944,609 | A | 7/1990 | Salter | |
| 6,149,309 | A | 11/2000 | Wojtkowski | |
| 6,468,194 | B2 | 10/2002 | Wojtkowski | |
| 6,604,859 | B1 | 8/2003 | Bonazoll | |
| 7,484,891 | B2 | 2/2009 | Keller | |
| 9,180,501 | B1 * | 11/2015 | Keller | B21B 31/074 |
| 2010/0284639 | A1 * | 11/2010 | Keller | B21B 31/07 384/428 |

* cited by examiner

ROLL ARRANGEMENT

RELATED APPLICATIONS

This application is a National Stage application of International application PCT/EP2013/061820 filed Jun. 7, 2013 and claiming priority of German application DE 10 2012 209 828.3 filed Jun. 12, 2012, both application being incorporated herein by reference thereto.

The invention relates to a roll arrangement for use in metallurgy and including a roll having a roll body and two roll necks, and a least one neck bushing for receiving at least one roll neck without a possibility of rotation relative thereto, wherein the outer surface of the roll neck and the inner surface of the neck bushing are formed cylindrical complementary to each other, and a carrier element is provided for formlockingly connecting the neck bushing and the roll neck without a possibility of rotation relative to each other.

Roll arrangements in which the roll necks are arranged in cylindrical or conical neck bushings are known from the state-of-the art. Carrier elements are arranged between the neck bushing and the roll neck for transmitting a circumferential force therebetween.

E.g., in rolling mills, an oil film support is used for supporting a back-up roll that absorbs the rolling force applied by an adjusting cylinder and transmits it to a work roll. Here, also high-loaded slide bearings are used which operate primarily in the Sommerfeld region, i.e., with a relatively low rotational speed and under a high load. At very high pressures, partially above 1,500 bar that is created in the load zone, an elastic deformation or flattening of pressure-loaded surfaces take place. The flattening produces large pressure-active surfaces facing in the acting direction of the outer force applied, e.g., by the adjusting cylinder. Thus, the bearing can withstand to a greater force. This effect is called "Electrohydrodynamic (EHD) increase of a load-bearing capacity. To further increase this effect, a so-called Morgoil-KLX® bearing is used which includes a thin-walled, conical neck bushing used as a running surface, see U.S. Pat. No. 6,468,194 and European Publication EP 1 213 061.

The publication "Newsletter January 2009, SMS Group, 16, No. 1 Apr. 1, 2009, p.p. 50-51 "discloses use of Morgoil-KLX® bearing for roll support and which has a neck bushing for receiving a conical roll neck. For torque transmission, a key is provided between the neck bushing and the roll neck.

German Publication DE 38 76 663 T2 discloses a cylindrical bushing for supporting a bearing on a hydrodynamic lubrication film.

European Patent EP 1 651 876 B1 discloses an oil film bearing for a roll neck and supported in a bearing bushing having at least two inwardly located hydrostatic pockets.

German Publication DE 38 76 663 T2 discloses a bushing for supporting a bearing on a hydrodynamic lubrication film.

German Publication DE 603 03 052 T2 discloses a bushing for rotationally supporting a neck surface of a roll neck in a rolling mill, wherein the cylindrical bushing is formlockingly connected with the roll neck by a carrier element.

The drawback of the known solutions consists in that for transmission of very high loads, large dimensions of the support adapted to a load are needed.

The object of the invention is to further increase the load-bearing capacity of the roll arrangement, without increasing the dimensions and the chock size of the roll support. Simultaneously, the assembly expenses and the costs connected therewith should be as small as possible.

This object is achieved, according to the invention, with features of claim 1. The invention describes a roll arrangement for use in metallurgy and including a roll having a roll barrel and two roll necks, at least one neck bushing for receiving at least one roll neck for joint rotation therewith. The outer surface of the roll neck and the inner surface of the neck bushing are formed cylindrical complementary to each other. A carrier element is provided between the neck bushing and the roll neck for formlockingly connecting them for joint rotation with each other. The invention is characterized in that the roll neck is supported in the neck bushing with a radial clearance so that a rotationally symmetrical hollow space in form of the radial clearance is formed between the neck bushing and the roll neck in an unloaded condition.

The hollow space is exactly pre-dimensioned dependent on a maximal bearing force. The hollow space is formed as a rotationally symmetrical annular gap, i.e., as a circumferential hollow profile in a plane extending transverse to the longitudinal axis of the roll arrangement. Advantageously, the clearance provides that no pre-stress exists between neck bushing and the roll neck in a load-free condition.

The inventive hollow space provides an increased free space between the neck bushing and the roll neck in which the neck bushing can be locally flattened under load in the spatial region of the force application. The flattening of the neck bushing increases the pressure-active surface that is subjected to forces, which noticeably increases the load-carrying capacity of the roll arrangement, without need to increase its size. For details, see the section "Functionality" at the end of the description.

According to the first embodiment, it is contemplated that the hollow space is increased and limited by a rotationally symmetrical concave shape provided on an outer surface of the roll neck and/or on an inner surface of the neck bushing. The concave shapes form, limit, respectively, the rotationally symmetrical annular gap, as a portion of the rotationally symmetrical total hollow space. Advantageously, thereby, an additional increase of the pressure-active surface between the neck bushing and the roll neck and, to the same extent, between the neck bushing and the bearing busing, is achieved in case of a load, which leads to further increase of the load-carrying capacity of the support at the unchanged dimensions and size of the installation.

According to a further embodiment of the invention, it is contemplated that the outer surface of the roll neck and/or the inner surface of the neck bushing continues, in the region of its concave shape, when viewed in the longitudinal direction of the roll arrangement, at least sectionally in form of a straight-line, a sinus curve, a polygonal curve R(x)n-tenth degree, or as their combination.

It is further provided that a profile of the outer surface of the roll neck or the inner surface of the neck bushing in a region of its concave shape, when viewed in the longitudinal direction of the roll arrangement, in the transition region between two adjacent sections, is continuously differential. Thereby, the course of contour, also called profile below, is formed without edges between profile sections which adjoin each other, i.e., with a smooth transition in order to counter the drawbacks of a possible notch effect. In addition, in case of a load, formation of impress point, e.g., scoring points on the opposite surfaces of the neck bushing and the roll neck is prevented.

It is further contemplated that the contour of the outer surface of the roll neck or the contour of the inner surface of the neck bushing correlates, in the region of its concave profile, viewed in the longitudinal direction of the roll arrangement, i.e., in the axial direction, with the distribution of the bearing force in the axial direction so that as large as possible flattening of neck bushing is locally achieved in its elastic region under load, which leads to a maximal load-bearing capacity of the roll arrangement at an unchanged size.

According to the invention, the roll is formed as a back-up roll, intermediate roll, or work roll for use in a rolling mill stand.

It is further contemplated that the carrier element between the neck bushing and the roll neck is formed at least as a key. Advantageously, for force transmission, at least one standard component is used that as a cheap standard component for force transmission can be replaced without any problem in case of wear or destruction.

According to a still further embodiment of the invention, it is provided that the arrangement further includes at least one chock with a bearing bushing in which the neck bushing, together with the roll neck and/or with the roll, is received, with a load-carrying oil film being provided between the neck bushing and the bearing bushing.

Generally, the inventive arrangement provides a simple and cost-effective possibility to replace or to use the inventive roll arrangement for an available roll arrangement, e.g., in a rolling installation to provide for increase of the load-carrying capacity and performance, without the need to change the available installation space. The inventive arrangement can be easily mounted.

In case of repair, it can be easily and quickly replaced. Thereby, maintenance and serving costs are reduced, with a simultaneous increase of the efficiency.

Further features and advantages of the invention follow from dependent claims and the following description that describes in detail embodiments of the invention which are shown in the drawings. Here, in addition to the above-described combinations of features, the features themselves or in other combinations are essential to the invention.

DESCRIPTION

Figure 2A:
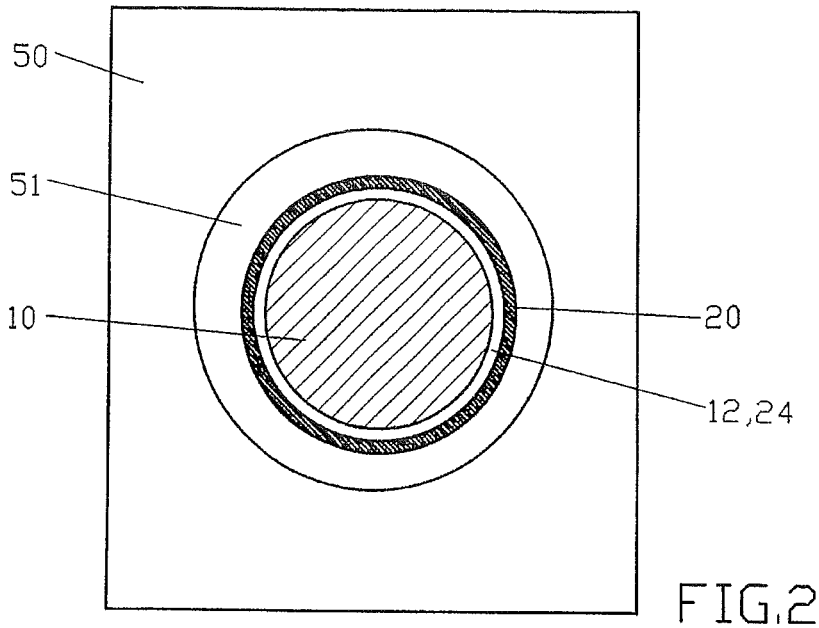
Figure 2B:
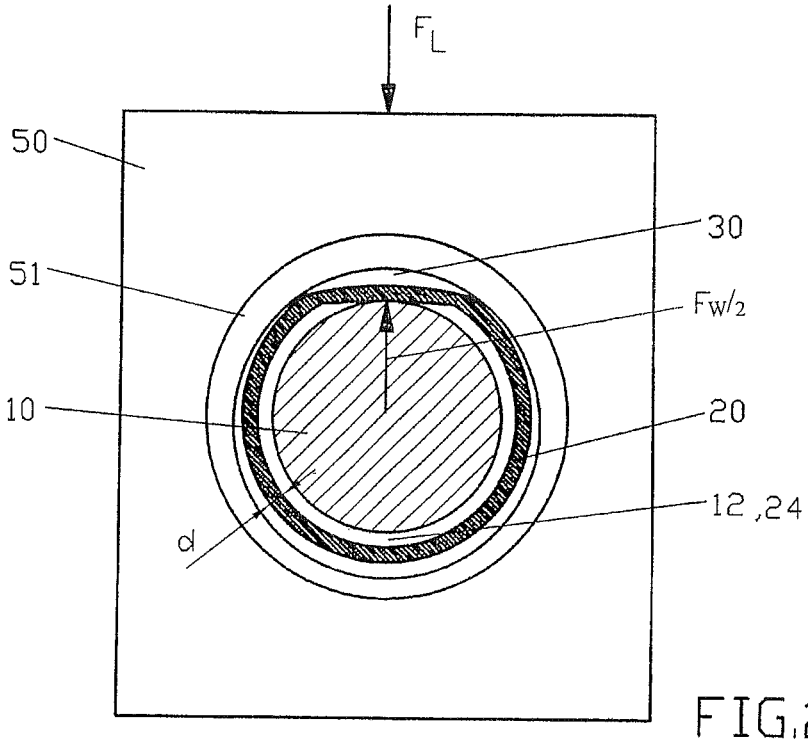
Figure 3A:
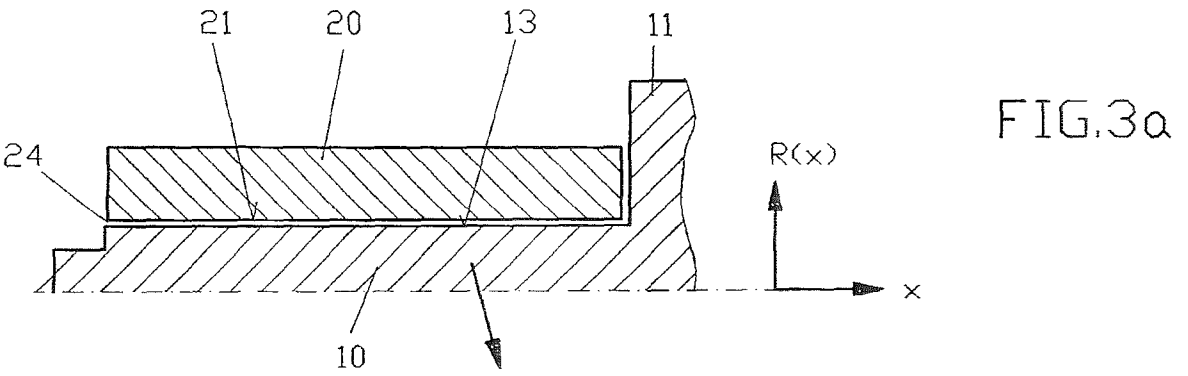
Figure 3B:
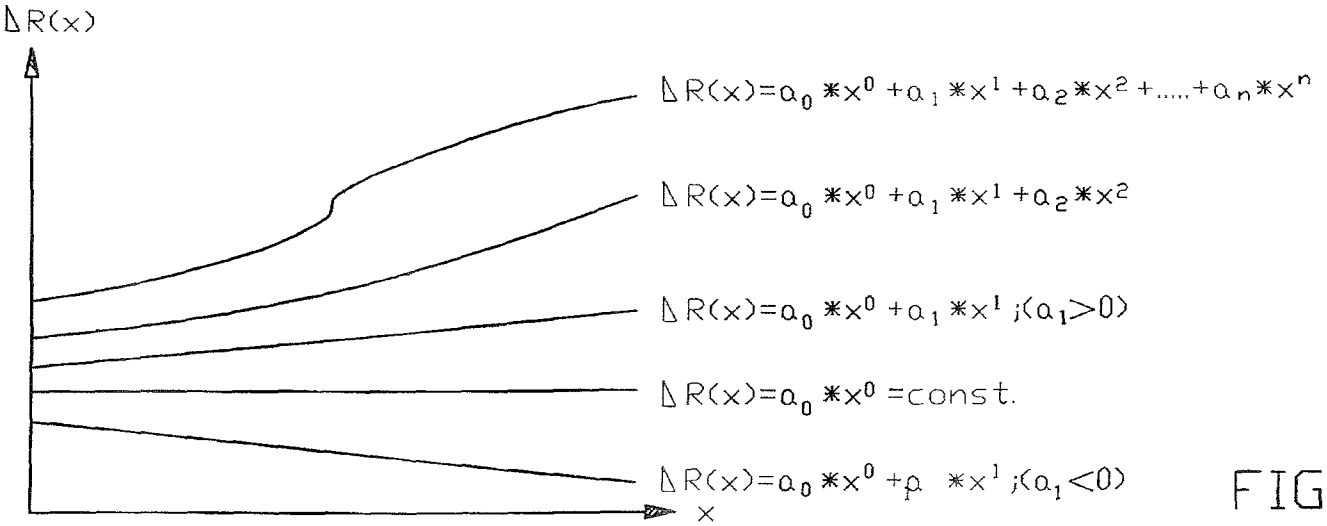

The invention will be described in detail below with reference to FIGS. 1 through 3*b*. It is shown in:

FIG. 1 a roll with a profiled cylindrical neck bushing;

FIG. 1*a* a detailed view of the depth of the profile,

FIG. 2*a* position of a roll neck in the neck bushing with a radial clearance in a non-loaded condition;

cross-sectional view in the region of the maximal total hollow area,

FIG. 2*b* deformation of the neck bushing with a radial clearance in a loaded condition;

cross-sectional view in the region of the maximal total hollow area;

FIG. 3*a* a schematic view of the position of the neck bushing on the roll neck with a clearance;

FIG. 3*b* different profile patterns of a roll neck surface or an inner surface of the neck bushing.

FIG. 1 shows a roll arrangement 100 for use, e.g., in metallurgy and including a roll having a roll barrel 11 and at least one cylindrical neck 10. The roll neck 10 is supported in a cylindrical receiving bore of a complementary neck bushing 20 with a radial clearance and for joint rotation therewith. The radial clearance between the neck bushing 20 and the roll neck 10 is formed by a rotationally symmetrical or surrounding the roll neck 10, hollow space 12. The radial clearance insures an easy withdrawal of the roll neck 10 from or pushing it in the neck bushing 20. The radial clearance, i.e., the diameter difference between the neck bushing 20 and the roll neck 10 is preferably in a range between 0.10 mm and 0.80 mm.

The wall thickness d of the cylindrical neck bushing amounts to from 0.10 mm to 0.75 mm, without taking into consideration the optional rotationally symmetrical concave shape which will be described further below.

For limiting the push-in position of the neck bushing 20 when it is pushed on the roll neck 10, a spacer ring 28 with a stop 25 is arranged between the end side of the roll barrel 11 and the neck bushing 20. Alternatively, the roll barrel can be provided, on its end side, with a heel, as a stop 25 (not shown), that is formed as one-piece with the roll barrel. The neck bushing 20 is tightened and secured in the axial direction (x) against the stop 25 from axial displacement, after being pushed on the roll neck 10, with a pressure shoulder ring 17 via an axial bearing-inner ring 16 optionally provided for supporting the roll neck 10, and a nut 18. Here, the roll neck 10 is provided at its end with a hub portion 26 for mounting the shoulder ring 17 and an adjacent thereto, threaded neck portion 27 for receiving the nut 18. In addition, the nut 18 can be secured against loosening with a rotation-preventing element 19, e.g., a counter-nut.

For providing a form-locking connection and for transferring circumferential forces which are generated during rotation, at least one carrier element 23, e.g., in form of a key, is arranged between the neck bushing 20 and the roll neck 10. According to a further embodiment, the at least one carrier element can be formed integrally with the roll neck 10 or the neck bushing 20.

E.g., the inner surface 21 of the neck bushing 20 can be provided with a circumferential or rotationally symmetrical concave profile produced, e.g., by drilling and/or grinding and which would be called further below as a characteristic shape or profile 40. The profile 40 of the inner surface 21 of the neck bushing 20 is contoured in the region of its concave shape, viewing in direction of the longitudinal cross-section of the neck bushing 20, at least sectionally, in form of straight line, sinus curve, polygonal curve R (x) n-tenth degree, preferably second degree in form of parabola, or a combination of those. Alternatively or additionally, the outer surface of the roll neck can have a circumferential or rotationally symmetrical profile.

With a concave curve shape of the profile of the roll neck 10 and/or of the neck bushing 20 (the first one is not shown in FIG. 1), necessarily depressions with a depth t in form of rotationally symmetrical annular crevices increase the rotationally symmetrical hollow space 12 which is formed by the already existing, in the non-loaded condition, radial clearance between the neck bushing 20 and the roll neck 10. The hollow space 12, thus, consists altogether of a radial clearance plus crevices in form of an annular gap, forming a circumferential hollow profile around the roll neck 10 in a plane extending transverse to the central axis of the roll neck.

Upon application of a rolling force $F_W$ (Action) to the roll arrangement which is compensated by a sum of half-value oppositely directed bearing forces $F_L$ (reaction) on both roll necks, the profile 40 of the inner surface 21 of the neck bushing 20 is adapted to or nestles against the cylindrical outer surface 13 of the roll neck 10 locally and elastically, whereby, as a result, a greater support surface is formed between the neck bushing 20 and a bearing bushing 51, as shown in detail in FIG. 2*b*, which leads to optimization of pressure distribution of the bearing force $F_L$. In FIG. 1, the curve 44 shows the pressure distribution according to the state-of-the art, whereas the curve 46 shows the optimal distribution in the inventive roll arrangement in case of application of a load, respectively, in the axial direction.

FIG. 1 shows the roll arrangement in a partially loaded condition. The partial load is so large that in unloaded condition, a portion of the hollow space in FIG. 1 defined by the radial clearance, is compressed at the point of load application at the top of the roll arrangement. At partial loading according to FIG. 1, the neck bushing rests, only in partial regions, with the supporting surfaces 14 on both sides on the roll neck. In comparison, a portion on the hollow space, which is formed by a concave profile of the neck bushing is available and recognizable. The force effect in FIG. 1 is not at its maximum. In particular, it is not yet so large that the additional portion of the hollow space, which is formed by the concave profile of the neck bushing, disappears on the outer side of the roll arrangement and that neck bushing abuts the roll neck over its entire axial length. This load case requires greater rolling and bearing forces $F_W$ and $F_L$ (not shown in FIG. 1).

The depth t of the profile 40 or the size of the resulting additional hollow space 12 between the neck bushing 20 and the roll neck 10 is so adapted, dependent on a maximum generated rolling force $F_W$ and the elasticity module of the neck bushing, that the volume of the hollow space 12 becomes greater the greater is the maximal rolling force in the loaded condition, whereby the deformation of the neck bushing 20 always remains in the elastic region. The actual depths t of the profiles range in the micrometer (μm)—region, preferably, up to 1,000 μm.

The illustrated roll can preferably be formed as back-up roll, or intermediate roll, or work roll for use in a rolling stand. The rolling stand can form a portion of a rolling line of a rolling mill.

In addition, at least one chock with a bearing bushing 51 can be provided for receiving the neck bushing 20 together with the roll neck 10, wherein a load-carrying oil film is provided between the outer surface 22 of the neck bushing 20 and bearing bushing 51 of the chock 50. The arrangement is called also as load-carrying oil film support. According to a preferred embodiment, the inner surface of the bearing bushing 51 is coated with anti-friction metal lining, e.g., with babbit metal.

To prevent a micro-cold welding resulting from micro-friction, a lubrication film 31 is provided between the neck bushing 20 and the roll neck 10.

A detail view in FIG. 1*a* clarifies, at an increased seal, the total clearance between the outer surface 13 of the roll neck and the inner surface 21 of the neck bushing. The total clearance is produced by a pre-selected fit tolerance (clearance fit) between the roll neck 10 and the neck busing 20 that is not shown in detail in FIG. 1*a*, and the depth t of the profile.

The view in FIG. 2*a* shows a cross-section of the position of the roll neck 10 in the neck bushing 20 with a radial clearance 24 in the unloaded condition. The radial clearance between the neck bushing 20 and the roll neck 10 forms the circular hollow space 12.

FIG. 2*b* shows support of the roll neck 10 in the neck bushing 20 with a radial clearance in a loaded condition. The hollow space 12 between the neck bushing 20 and the roll neck 10 is locally interrupted at the load application point in case of loading. The neck bushing 20 is supported, as the drawing shows, on the roll neck 10 at the loading point and nestles thereon. The neck bushing 20 undergoes, at a pressure load, an elastic deformation that takes place from the pre-dimensional hollow space 12 in the contact region. The pressure distribution between the neck bushing 20 and the roll neck 10 takes place in such a way that an increased flattened surface between the neck bushing 20 and the roll neck 10 is formed for force transmission, wherein the flattening is transmitted to the same extent to the outer surface 22 of the neck bushing 20 so that a maximal support surface or a hydrodynamic maximal pressure area between the neck bushing 20 and the roll neck 10 and between the neck bushing 20 and the bearing bushing 51 is formed; for details of the functionality see further below.

FIG. 3*a* shows a roll arrangement 100 with a roll and at least one neck bushing 20 that is provided on the roll neck with a radial clearance 24. Here, both the outer surface 13 of the roll neck 10 and the inner surface 21 of the neck bushing 20 are cylindrical, wherein the respective surfaces 13, 21 are complementary to each other and are separated, in the unloaded condition, by a radial clearance, whereby a rotationally symmetrically hollow space is formed.

In order to increase the load-bearing capacity in the roll arrangement shown in FIG. 3*a*, the hollow space which is based on the radial clearance, is to be suitably dimensioned dependent on occurring rolling force $F_W$ and bearing force $F_L$. In addition, there can be provided, optionally, according to the invention, rotationally symmetrical profiles 40 on the inner surface 21 of the neck bushing 20 and/or the outer surface 13 of the roll neck in order to further increase the hollow space. FIG. 3*b* shows examples of possible profiles in axial direction in form of a mathematical functions R(x)n-tenth degree which, dependent on the load, can be used in combination with other profiles. In order to insure a uniform edge-free transition of combined profile sections, the profile 40 is formed so it is constantly differentiated in the transition region between two profile sections. It is to be noted that the curve lines shown in FIG. 3*b* do not actually illustrate the profiles used in practice. The illustrated number of curve or profile sections simply show schematically different possible profiles.

Functionality

The inventive rotationally symmetrical hollow space 12 between the neck bushing 20 and roll neck 10, which is formed of the radial clearance therebetween and, optionally, the profile 40, provide between the neck bushing 20 and the roll neck 10, an increased free space in which the neck bushing 20 can expand at the location of the force effect.

In this way, during a rolling operation in a rolling mill stand, at least essentially vertically upward directed rolling force $F_W$ acts on the upper (back-up) roll, whereas simultaneously at least essentially vertically downward directed rolling force Fw acts on the lower (back-up) roll. These rolling forces are transmitted from the roll barrels, respectively, by half on the roll necks, whereby the roll necks are pressed upwardly in the upper chock and downwardly in the lower chock.

The rolling forces are transmitted according to a functional chain, from the roll neck through the neck bushing, the load-carrying oil film between the neck bushing and the bearing bushing, the bearing bushing to the chock. The chock transmits the rolling forces further to the rolling mill stand in which the chock is supported.

Ideally, the chock and the bearing bushing supported in the chock, should be seen as unyielding to and incompressible by the rolling forces. I.e., the chock and the bearing bushing completely absorb acting thereon respective halves of the rolling forces $F_{W/2}$ (action), while they, respectively, repulse the equal but oppositely directed bearing forces.

Already when a small rolling force $F_W$ acts on a roll neck 10 during the rolling operation, the roll neck 10, together with the neck bushing 20, apply pressure in the direction of the rolling force $F_W$ to the chock via the load-carrying oil film 30 and the bearing bushing 51, see FIG. 2*b*. But here, the neck bushing 20 impacts the incompressible load-carrying oil film 30 that itself acts on the unyielding bearing bushing 51 and the unyielding chock, which prevents yielding in the direction of the rolling force. Consequentially, the neck busing is prevented from yielding by the opposite bearing force $F_L$ in the direction of the rolling force.

The neck bushing 20 itself, together with the inventive hollow space 12 toward the roll neck 10, is the weakest link in the above-discussed functional chain of the (rolling) force.

While the neck bushing 20 cannot avoid the rolling force, the load applied during the rolling operation, causes an elastic deformation of the neck bushing 21. Under the action of the rolling force $F_{W/2}$ and/or the oppositely directed bearing force $F_L$, the neck bushing deforms inwardly in the original hollow space 12 and flattens. The flattening takes place maximum so far until the neck bushing applies pressure to the roll neck 10 and is supported thereby. The neck bushing 20 conforms locally and elastically to the profile 40 of the roll neck and deforms again to its initial condition after being unloaded. The flattening increases the pressure-active surface between the neck bushing 20 and the bearing bushing 51. The load-carrying oil film 30 is provided between the neck bushing 20 and the bearing bushing 51. The load-carrying oil film forms a so-called hydrodynamic load-carrying oil film support. The inventive roll arrangement leads, due to the increase of the pressure-active surface, to the increase of the loading capacity of the load-carrying oil film support between the neck bushing and the bearing bushing.

In reality, the rolling force and/or the bearing force do not act punctiformingly or linearly but rather in form of force curve. The force curve has a flat elongation in the circumferential direction and the axial direction. Due to flattening of the neck bushing and, thereby, increase of the pressure-active surface, a noticeable increase of the load-bearing capacity of the roll arrangement for the flatly elongated force curve is achieved.

The inventive roll arrangement has further advantages in comparison with a roll arrangement in which the neck bushing is force-lockingly connected with the roll neck with a pre-stress in the unloaded condition, e.g., as a result of shrinkage. The necessary force that need be applied for the elastic flattening of the neck bushing, is smaller because of the inventive hollow space in comparison with a construction with a pre-stress between the neck bushing and the neck. The pre-stressed construction requires a greater force in order to realize the same deformation of the neck bushing.

Other Aspects:

Because of a small wall thickness of the neck bushing 20, the deformation under load of the inner surface 21 of the neck bushing 20 is reproduced, without change, i.e., in the same direction on the outer surface 22 of the neck bushing 20 and, thereby, results in increase (widening) of the pressure-active surface between the neck bushing 20 and in the bearing bushing 51 which faces the force direction. This further results in uniform distribution of the lubrication film pressure, so that a greater force can be absorbed, without the maximum pressure in the load-carrying oil film 30 exceeding the threshold of the material of the bearing bushing or the anti-friction metal coating. As a result, the inventive arrangement leads to increase of the loading capacity of the hydrodynamic lubricant or load-carrying oil film support between the neck bushing 20 and the bearing bushing 51.

LIST OF REFERENCE NUMERALS

100 Roll arrangement
10 Roll neck
11 Roll barrel
12 Hollow space
13 Outer surface of the roll neck
14 Bearing surface
15 Central axis
16 Axial bearing-inner ring
17 Pressure shoulder ring
18 Nut
19 Counter-nut
20 Neck bushing
21 Inner surface of the neck bushing
22 Outer surface of the neck bushing
23 Carrier Element
24 Radial clearance
25 Stop
26 Hub portion
27 Threaded neck
28 Spacer ring
30 Load-carrying oil film
31 Lubricant film
40 Profile
44 Pressure distribution-state-of-the art
46 Optimal pressure distribution
50 Chock
51 Bearing bushing
R(x) Profile as a mathematical function
$F_W$ Rolling force
$F_L$ Bearing force
t Profile depth
d Wall thickness of the neck bushing

The invention claimed is:

1. A roll arrangement (100) for use in metallurgy, comprising:

a roll having a roll barrel (11) and two roll necks (10);

at least one neck bushing (20) for receiving at least one of the two roll necks (10) for a joint rotation therewith, wherein an outer surface (13) of the at least one roll neck (10) and an inner surface (21) of the at least one neck-bushing each has a cylindrical shape; and a carrier element (23) for formlockingly connecting the at least one neck bushing (20) and the at least one roll neck (10) for joint rotation, wherein the at least one roll neck (10) is supported in the at least one neck bushing (20) with a radial clearance; and wherein the radial clearance forms a rotationally symmetrical hollow space (12) between the at least one neck bushing (20) and the at least one roll neck (10) in an unloaded condition, characterized in that the rotationally symmetrical hollow space (12) is limited, when viewed in a longitudinal direction of the roll arrangement (100) by a rotationally symmetrical concave shape provided on the outer surface (13) of the at least one roil neck (10) or on the inner surface (21) of the at least one neck bushing (20).

2. An arrangement according to claim 1, characterized in that the outer surface (13) of the at least one roll neck (10) or the inner surface (21) of the at least neck bushing (20) continues, in the region of the concave shape thereof, when viewed in the longitudinal direction of the roll arrangement (100), at least in form of a section of a straight-line, a sinus curve, a polygonal curve R(x)n-tenth degree, or as combination thereof.

3. An arrangement according to claim 1, characterized in that a profile of the outer surface (13) of the at least one roll neck (10) or the inner surface (21) of the at least one neck bushing (20) in a region of the concave shape thereof, when viewed in the longitudinal direction of the roll arrangement (100), in a transition region between two adjacent sections, is continuously differential.

4. An arrangement according to claim 1,
characterized in that
a volume of the rotationally symmetrical hollow space (12) is formed so that it conforms to a maximal bearing force F in a loaded condition as long as deformation of the at least one neck bushing (20) remains in an elastic region.

5. An arrangement according to claim 1,
characterized in that
the roll is formed as a back-up roll, intermediate roll, or work roll for use in a rolling mill stand.

6. An arrangement according to claim 1,
characterized in that
the carrier element (23) between the at least one neck bushing (20) and the at least one roll neck (10) is formed at least as a key.

7. An arrangement according to claim 1,
characterized in that
the arrangement further comprises:
at least one chock (50) with a bearing bushing (51) in which the at least one neck bushing (20), together with at least one of the at least one roll neck (10) and the roll, is received, with a load-carrying oil film (30) being provided between the at least one neck bushing (20) and the bearing bushing (51).

* * * * *